United States Patent [19]

Lien et al.

[11] 3,967,150

[45] June 29, 1976

[54] GRID CONTROLLED ELECTRON SOURCE AND METHOD OF MAKING SAME

[75] Inventors: Erling L. Lien, Los Altos; George V. Miram, Atherton; Richard B. Nelson, Los Altos Hills, all of Calif.

[73] Assignee: Varian Associates, Palo Alto, Calif.

[22] Filed: Jan. 31, 1975

[21] Appl. No.: 545,867

[52] U.S. Cl. ..... 313/338; 313/304; 313/348; 313/447; 313/446; 29/25.14

[51] Int. Cl.[2] ..... H01J 1/20; H01J 19/14

[58] Field of Search ..... 313/293, 348, 349, 350, 313/446, 447, 448, 449, 452, 304, 338; 29/25.14

[56] References Cited

UNITED STATES PATENTS

| | | | |
|---|---|---|---|
| 2,068,287 | 1/1937 | Gabor | 313/338 X |
| 2,782,334 | 2/1957 | Gardner | 313/338 X |
| 3,119,041 | 1/1964 | Harris | 313/338 X |
| 3,402,314 | 9/1968 | Vlaardingerbroek et al. | 313/348 |
| 3,648,096 | 3/1972 | Beggs | 313/348 |
| 3,818,260 | 6/1974 | Elfe, Jr. et al. | 313/348 |

*Primary Examiner*—Saxfield Chatmon, Jr.
*Attorney, Agent, or Firm*—Stanley Z. Cole; D. R. Pressman; Richard B. Nelson

[57] ABSTRACT

A grid-controlled electron source comprises an apertured grid spaced in front of a thermionic cathode. Areas of the cathode directly behind the grid conductors are made non-emissive by a bonded surface layer of non-emissive material such as zirconium. On porous metal cathodes impregnated with active emitting material the metal surface may be sealed with a dense layer of inactive metal under the non-emissive layer to prevent chemical reaction of the latter with the emitting material.

Methods of depositing the surface layers in the desired pattern include coating the cathode's entire large-scale surface contour, followed by machining small concave dimples into the surface, thereby removing the non-emissive layer from the dimpled surfaces from which small beamlets of electrons are focused between the grid conductors without grid interception.

Another method is to mask the desired non-emissive areas with an apertured mask having solid elements registered with the desired positions of the grid conductors. The surface behind the mask apertures is coated with an inactive powder, then the mask is removed and the non-emissive layer or layers deposited in the uncoated, previously masked paths. Lastly, the inactive powder is removed, uncovering the emissive surface areas.

21 Claims, 16 Drawing Figures

FIG.1
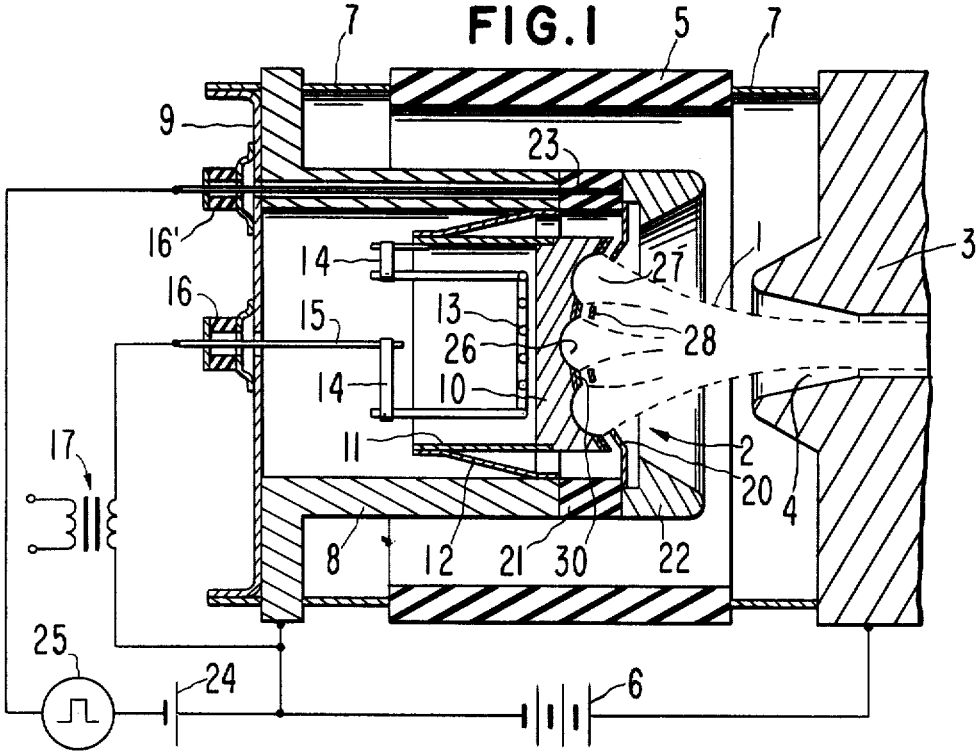
FIG.2
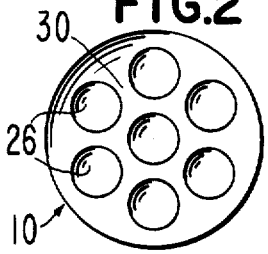
FIG.3a
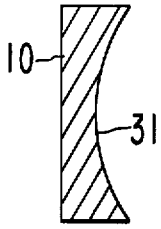
FIG.3b
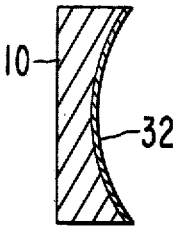
FIG.3c
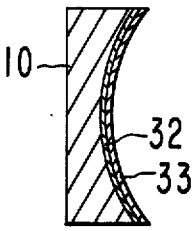
FIG.3d
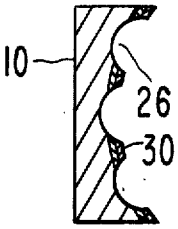
FIG.4
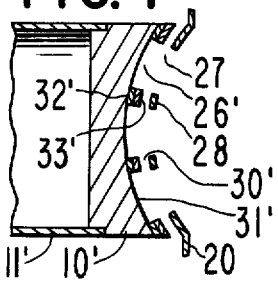
FIG.5a
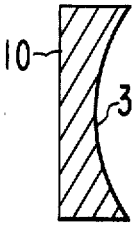
FIG.5b
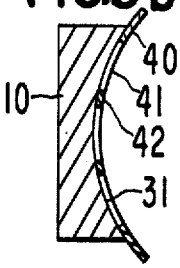
FIG.5c
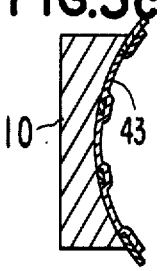
FIG.5d
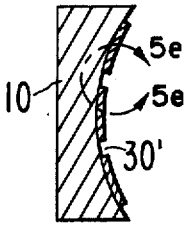
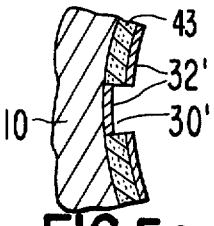
FIG.5e
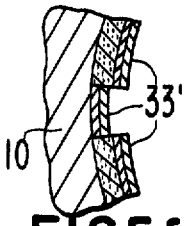
FIG.5f
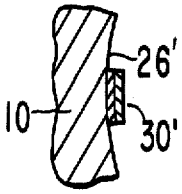
FIG.5g
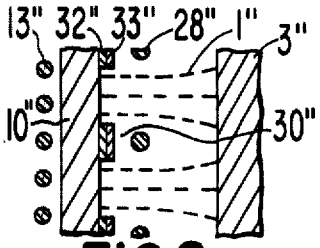
FIG.6
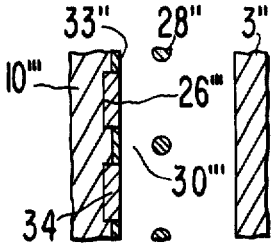
FIG.7

GRID CONTROLLED ELECTRON SOURCE AND METHOD OF MAKING SAME

FIELD OF THE INVENTION

The invention relates to grid-controlled electron sources such as are used in triodes and tetrodes to produce a stream of electrons modulated at high frequency for exciting an anode circuit. Grid controlled sources are also used in linear-beam microwave tubes to modulate the beam current into a series of short pulses. In either case the generation of high power electron streams requires that the control grid in front of the thermionic cathode swing to a potential positive with respect to the cathode when peak current is to be drawn. The grid then attracts electrons and can be harmfully heated by intercepting some electrons. The present invention is directed to an improved method for obviating such harmful heating.

DESCRIPTION OF PRIOR ART

A great deal of effort has been spent in methods to avoid grid interception. The approaches have been: (1) geometric forms of the cathode-grid structure which direct electrons into ballistic paths missing the grid conductors, (2) preventing emission from those portions of the cathode structure from which emitted electrons would flow to the grid, either by keeping those portions below emitting temperature or by causing their surfaces to be less emissive than the desired emitting areas of the cathode, and (3) combinations of the above methods.

U.S. Pat. No. 3,500,110 issued March 10, 1970 to D. L. Winsor describes an example of a "shadow grid" in which an apertured conductor, at cathode potential, is placed between the cathode and the control grid with its grid elements aligned behind those of the control grid. The shadow grid elements produce a convergent electric field in the enclosed emitting areas which directs electron paths away from the control grid elements. Since the shadow-grid elements are directly below the control grid elements, emission from the former would go directly to the control grid. However, the shadow grid is not in good thermal contact with the cathode, so it operates cooler and thus has lower thermionic emission.

A more sophisticated version of the shadow-grid is described in U.S. Pat. No. 3,558,967, issued Jan. 26, 1971 to G. V. Miram and assigned to the present assignee. Here the cathode emitting areas within the shadow grid mesh are dimpled to form concave surfaces, whereby the focusing of electrons through the control grid apertures is enhanced and the emission is more uniform over the cathode surface.

Although a significant and useful improvement, the shadow-grid approach has several problems, largely mechanical. The grid must be very close to the cathode so that high emission current can be drawn. A clearance of 0.001 inch is often required. The clearance must be maintained through the heating cycle of the structure, calling for elaborate compensation of differential thermal expansion. If the shadow-grid touches the cathode, it may overheat locally by thermal conduction and emit and the cathode may be cooled reducing its emission. Also, construction and mounting of the shadow-grid to assure accurate alignment with the control grid present severe mechanical difficulties. Lastly, the exact tolerances required in the shadow-grid construction and positioning make the electrical properties of the electron source sensitive to slight displacements due to shock and vibration.

Another approach to grid interception has been to deactivate the areas of the cathode itself lying behind the control-grid conductors. U.S. Pat. No. 3,814,972, issued June 4, 1974 to William Sain and assigned to the present assignee describes a tube in which these cathode areas are formed by the bare cathode base metal, not coated with activating emissive material. This technique has been quite successful with nickel cathodes coated with oxides of barium, strontium and calcium. There is however a small amount of surface migration of activating barium over the bare base nickel so that the bare areas do not remain completely nonemitting. The technique is not applicable to cathodes of porous tungsten impregnated with molten oxide activator.

SUMMARY OF THE INVENTION

A principal objective of the present invention is to provide a grid-controlled electron source of simple construction with reduced electron interception by the control grid.

A further objective is to provide an electron source with low control-grid interception comprising an impregnated cathode.

A further objective is to provide an electron source with low control-grid interception having rugged mechanical properties.

A still further objective is to provide an electron source with low control-grid interception which may be accurately fabricated by simple techniques.

A still further objective is to create accurate fabrication techniques for an electron source with low control-grid interception.

These objectives have been met in the present invention by depositing on the areas of the cathode behind the control-grid conductors a layer of material such as zirconium which is non-emissive at the cathode operating temperature even in the presence of activating material exuding from the cathode. When deposited on an impregnated cathode the non-emissive material is shielded from chemical reaction with the impregnant by first forming a layer of dense, inactive metal sealing the surface of the porous metal cathode body. The sealing may be done by localized fusion of the surface of the porous metal or by deposition of a dense surface layer.

A dimpled cathode structure may be fabricated by (1) forming the dense sealing layer over the entire cathode front surface, (2) depositing the non-emissive material on the sealing layer, and (3) machining the dimples into the cathode base material, cutting through the surface layers and leaving the spaces between dimples coated with the surface layers.

A smooth cathode structure may be fabricated by (1) fixing to the cathode surface an apertured mask with solid members corresponding to the desired non-emissive areas, (2) coating the cathode with an inactive powdered material, (3) removing the mask exposing the desired non-emissive areas, (4) sealing the surface by depositing a dense layer of inactive metal, (5) depositing a layer of non-emissive material, and (6) brushing away the inactive powder, carrying off the deposited layers from the desired emissive areas.

BRIEF DESCRIPTION OF THE DRAWINGS

FIG. 1 is an axial section of an electron gun suitable for a linear beam microwave tube, including a dimpled cathode.

FIG. 2 is a view of the cathode of FIG. 1 taken perpendicularly to the gun axis.

FIGS. 3*a*–3*d* are a series of schematic views showing the steps in making the cathode structure of the gun of FIG. 1.

FIG. 4 is an axial section of the cathode-grid portion of an electron gun suitable for a linear beam tube, including an essentially smooth cathode.

FIGS. 5*a*–5*d* are a series of schematic views showing the steps in making the gun of FIG. 4.

FIG. 6 is a sectional view of a planar triode embodying the present invention.

FIG. 7 is a sectional view of a planar triode with a smooth coated cathode.

DESCRIPTION OF THE PREFERRED EMBODIMENTS

FIG. 1 shows a grid-controlled electron gun such as used in high power, pulsed klystrons or traveling wave tubes. A converging beam of electrons 1 from a grid controlled electron source 2 is drawn toward a reentrant anode 3 as of copper and passes through a central aperture 4 to emerge as a cylindrical linear beam adapted to interact with microwave circuits, not shown, to generate high frequency energy. The vacuum envelope around source 2 comprises dielectric cylinder 5 as of alumina ceramic adapted to withstand the dc voltage of the cathode-anode power supply 6. Cylinder 5 is joined at its ends, as by brazing, to thin metal sleeves 7 of material approximating the thermal expansivity of ceramic 5, as an alloy of iron, nickel and cobalt. Sleeves 7 are joined, as by brazing or welding, to anode 3 and to a flanged metallic gun support cylinder 8 as of porous tungsten impregnated with copper. The end of the vacuum envelope is closed by a cup shaped header 9 as of austenitic stainless steel joined as by welding to gun support 8.

Thermionic cathode 10 as of porous tungsten impregnated with barium aluminate is mounted as by welding on a hollow cylindrical support sleeve and heat conductor 11 as of molybdenum. Sleeve 11 is supported as by spot welding on gun support 8 via a thin metallic sleeve 12 as of molybdenum-rhenium alloy serving as a heat dam. Cathode 10 is heated by radiation from a spiral heater 13 as of tungsten wire with ends connected by tabs 14 as of molybdenum-rhenium alloy to sleeve 11 and a heater lead-in wire 15 as of molybdenum through the vacuum envelope via a ceramic insulator 16. Heater current is supplied by a transformer 17 between lead-in 15 and gun support 8.

The front emissive surface of cathode 10 is grossly a concave spherical shape. Control of the electron beam current from source 2 is by an apertured spherical grid 20 as of molybdenum-rhenium alloy spaced in front of cathode 10 and mounted as by brazing on a cylindrical dielectric ring 21 as of beryllium oxide ceramic which is in turn brazed to gun support 8 to provide thermal conductive cooling of grid 20. A focus electrode 22 connected to grid 20 and also brazed to ceramic ring 21 provides proper electric field shape at the edge of beam 1. Grid 20 is connected by a wire 23 passing through a small hole in ring 21 and gun support 8 and through header 9 via a second ceramic insulator 16'.

Grid 20 is biased slightly negative to cathode 10 by a dc voltage supply 24. When beam current is to be drawn grid 20 is pulsed to a voltage positive to cathode 10 by pulser 25.

The front, generally spherical surface of cathode 10 is indented by a pattern of small concave spherical dimples 26. The apertures 27 in grid 20 are in registry with dimples 26 so that electron current from the surface of dimples 26 is focussed through grid apertures 27 without striking the conducting members 28 of grid 20.

The resulting beamlets of current merge to form electron beam 1. The "land" areas 30 of cathode 10 between dimples 26 lie directly beneath grid mesh members 28. According to the present invention, land areas 30 are coated with emission-inhibiting material to eliminate electron current from them directly to overlying grid members 28.

FIG. 2 shows the pattern of dimples 26 and "land areas" 30 on cathode 10 (corresponding to apertures 27 and conducting members 28 of grid 20).

FIG. 3 shows the steps in a preferred method of fabricating a dimpled cathode with non-emitting lands:

a. A button of porous metal as of tungsten impregnated with a filler such as copper or thermosetting plastic is machined to form a concave spherical surface 31 covering the entire front face of the button. The filler is then removed.

b. A layer of dense, inactive metal 32 is formed on the front surface, sealing over the pores. The sealing may be done by laser welding a pattern covering the surface to melt the base metal to a depth sufficient to flow over the pores. Alternatively, a dense surface layer 32 may be deposited from an external source, as by chemical vapor deposition of tungsten from tungsten hexafluoride vapor onto the hot substrate 10. The porous body is then impregnated with electron emissive material, as barium aluminate.

c. A layer of non-emissive material 33 is deposited on the sealing layer 32. Materials are known which are non-emissive at the operating temperature of impregnated cathodes, i.e., about 1050°C, even when exposed to the active evaporated products of such cathodes such as barium oxide and metallic barium. These materials include active metals such as zirconium and titanium, carbon, and metallic carbides such as molybdenum carbide. Most of these materials are strong reducing agents and react chemically with activator materials such as barium aluminate. The purpose of inert sealing layer 32 is to reduce the contact between the two reactive materials. Layer 33 may be deposited by chemical vapor deposition from a gas, by vacuum evaporation, gas discharge sputtering, etc.

d. Small spherical dimples 26 are cut into the large spherical surface 31, as by a ball milling cutter. Active emitter material is exposed on the dimple surface while the non-emissive layer 33 is left on the intervening lands 30.

FIG. 4 shows an alternative embodiment of the invention wherein the completed cathode surface 31 is a smooth part of a large sphere with non-emissive material deposited on the areas 30' below grid conductor elements 28. The focusing of electron beamlets from emissive areas 26' through the grid apertures 27 is not as good as in the dimpled structure and the cathode emission density is not as uniform. However, the structure is cheaper to make than the individually machined dimples and the pattern is not limited to an array of circular emitters.

FIG. 5 illustrates the steps in a preferred method of fabricating the cathode of FIG. 4. (*a*) The spherical cathode surface is formed as in FIG. 3. (*b*) A spherical mask 40 of thin metal, having apertures 41 corresponding to the desired emissive areas 26′ and solid members 42 corresponding to the desired non-emissive areas 30′ is placed on the concave spherical cathode surface 31. (*c*) An inert, powdered material 43, such as barium carbonate, is coated over the surface of cathode 31 and mask 40. (*d*) Mask 40 is removed, leaving areas 30′ bare of the inert powder. (*e*) (Enlarged detail) A layer of pore-sealing metal 32′ is deposited on exposed areas 30′ and powder coating 43. (*f*) A layer of non-emissive material 33′ is deposited on pore-sealing layer 32′. (*g*) Powder layer 43 is removed, as by brushing, carrying away the materials deposited on it, leaving emissive areas 26′ bare and non-emissive areas 30′ coated with the deposited layers.

FIG. 6 shows a section of a small area of a planar triode embodying the present invention. Here the anode 3″ is flat and collects electron stream 1″ directly. Flat cathode 10″ heated by radiant heater 13″ has non-emissive areas 30″ coated with layer 32″ of pore-sealing material and 33″ of non-emissive material deposited according to the process of FIG. 5. Grid conductors 28″ are round wires as of tungsten stretched across a grid frame (not shown).

Embodiment of the invention in a cylindrical grid-controlled tube involves only curving the structure of FIG. 6 around a cylinder axis parallel to the grid wires.

The process of FIG. 3 may also be used in a triode by forming the large-scale cathode face as a plane or cylinder and cutting cylindrical section concave grooves for the emitting areas 26″ instead of spherical dimples.

FIG. 7 shows an embodiment of the invention in a tube with an oxide-coated cathode, shown here as a planar triode for illustrative purposes. Here cathode base 10‴ is a solid metal slab as of nickel instead of an impregnated porous metal. The process is analogous to that of FIG. 3 except that the pore-sealing layer 32 (step b) is unnecessary. Non-emissive layer 33″ is deposited on base 10‴. Then grooves 26‴ are machined into base 10‴ leaving non-emissive layer 33″ on the lands between them. Activating material as barium-strontium-calcium carbonate powder is coated over the structure and removed as by scraping from non-emissive areas 33″. At the same time the oxide emissive surface 34 between lands is scraped smooth. After the cathode is activated by heating the carbonates to break down into oxides, the non-emissive layer 33″ behind grid wires 28″ resists activation by diffusion of activating material from the emissive areas.

Many other embodiments of the invention will be obvious to those skilled in the art. The preferred embodiments described are intended to be illustrative and not restrictive.

What is claimed is:

1. A grid-controlled electron source comprising, a thermionic cathode and a control grid spaced adjacent said cathode, said grid comprising multiple apertures separated by conductive members, said cathode having a surface facing said control grid, said surface comprising, electron emissive areas facing said multiple apertures, and non-emissive areas facing said conductive members, said non-emissive areas comprising deposited portions of a layer of non-emissive material on said surface facing said control grid.

2. The apparatus of claim 1 wherein said cathode comprises a body of porous metal and a source of activating material.

3. The apparatus of claim 2 wherein said activating material is impregnated into the pores of said porous metal.

4. The apparatus of claim 2 wherein said non-emissive areas further include a dense layer of inactive metal underlying said deposited layer of non-emissive material.

5. The apparatus of claim 1 wherein said non-emissive material is zirconium or titanium.

6. The apparatus of claim 1 wherein said non-emissive material is carbon or a metallic carbide.

7. The apparatus of claim 1 wherein said emissive areas are multiple concave depressions in a smooth surface of said cathode, said smooth surface containing said non-emissive areas.

8. The apparatus of claim 7 wherein said concave depressions are sections of spheres.

9. The apparatus of claim 7 wherein said concave depressions are sections of circular cylinders.

10. A process for fabricating a thermionic cathode comprising an emitter-base material, non-emissive surface areas, and multiple emissive surface areas, said process comprising the steps of; forming on said base material a smooth surface shaped to conform to said non-emissive areas, then depositing on said smooth surface a layer of non-emissive material, then removing areas of said layer and a portion of underlying base material to form said emissive areas.

11. The process of claim 10 further including the subsequent step of coating said emissive areas with emissive material.

12. The process of claim 11 wherein said emissive material is coated over said emissive areas and said non-emissive areas and then mechanically removed from said non-emissive areas.

13. A process for fabricating a thermionic cathode comprising a porous metal body, a source of activating material dispersed in the pores of said body, multiple electron emissive surface areas and non-emissive surface areas, said process comprising the sequential steps of; forming a smooth surface on said metal body, forming a layer of dense metal sealing the pores of said surface, depositing a layer of non-emissive material on said dense metal layer, removing areas of said layers and a portion of underlying porous metal to form said emissive areas.

14. The process of claim 13 wherein said porous metal body is impregnated with said activating material.

15. The process of claim 14 further including the step of impregnating said porous metal body with said activating material before removing said layers and said portion of underlying porous metal.

16. A process for fabricating a thermionic cathode comprising an electron emissive base material, emissive surface areas and non-emissive surface areas, said process comprising the steps of; forming on said base material a smooth surface containing said emission areas, affixing to said surface a mask with apertures over said emissive areas and solid members over said non-emissive areas, depositing a layer of removable material on said emissive areas, removing said mask exposing said non-emissive areas, depositing a layer of non-emissive material on said removable material and said non-emissive areas, and removing said removable material and said non-emissive material from said emissive areas.

17. The process of claim 16 wherein said removable material is a non-metallic powder.

18. A process for fabricating a thermionic cathode comprising a porous metal base material, an activating material dispersed in the pores of said base material, electron emissive surface areas and non-emissive surface areas, said process comprising the steps of; forming on said base material a smooth surface containing said emissive areas, affixing to said surface a mask with apertures over said emissive areas and solid members over said non-emissive areas, depositing a layer of removable material on said emissive areas, removing said mask exposing said non-emissive areas, depositing a layer of dense metal on said layer of removable material and on said non-emissive areas to close over the pores in said non-emissive areas, depositing a layer of non-emissive material on said layer of dense metal, and removing said removable material and said deposited layers from said emissive areas.

19. The process of claim 18 wherein said porous base metal is impregnated with said activating material.

20. The process of claim 19 further including the step of impregnating said porous base metal with said activating material before depositing said removable material.

21. The process of claim 10 wherein said emitter base is a body of porous metal having an activator material dispersed in the pores of said body.

* * * * *